US007515856B2

(12) United States Patent
Ohyama

(10) Patent No.: US 7,515,856 B2
(45) Date of Patent: Apr. 7, 2009

(54) IMAGE FORMING APPARATUS, A PROCESS CARTRIDGE PROVIDED IN THE APPARATUS, AND A DEVELOPING DEVICE INCLUDED IN THE PROCESS CARTRIDGE OF THE APPARATUS

(75) Inventor: Kunihiro Ohyama, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 133 days.

(21) Appl. No.: 11/557,070

(22) Filed: Nov. 6, 2006

(65) Prior Publication Data

US 2007/0104518 A1 May 10, 2007

(30) Foreign Application Priority Data

Nov. 7, 2005 (JP) ..... 2005-322188

(51) Int. Cl.
*G03G 15/09* (2006.01)

(52) U.S. Cl. ..... 399/274

(58) Field of Classification Search ..... 399/274, 399/284

See application file for complete search history.

(56) References Cited

U.S. PATENT DOCUMENTS

| | | | | |
|---|---|---|---|---|
| 5,583,622 | A * | 12/1996 | Nishimura | 399/274 |
| 5,920,754 | A * | 7/1999 | Chung et al. | 399/274 X |
| 6,208,826 | B1 | 3/2001 | Yoshinaga et al. | |
| 6,522,855 | B1 * | 2/2003 | Katoh et al. | 399/274 |
| 6,810,222 | B2 | 10/2004 | Ohyama | |
| 6,856,774 | B2 | 2/2005 | Sampe et al. | |
| 6,873,814 | B2 | 3/2005 | Ohjimi et al. | |
| 2004/0190948 | A1 * | 9/2004 | Sano et al. | 399/274 |
| 2004/0202495 | A1 * | 10/2004 | Koike et al. | 399/159 |
| 2005/0169663 | A1 | 8/2005 | Shintani et al. | |

FOREIGN PATENT DOCUMENTS

| | | | |
|---|---|---|---|
| JP | 2002-341646 | | 11/2002 |
| JP | 2004-069789 | | 3/2004 |
| JP | 2004-109284 | | 4/2004 |
| JP | 2004-226685 | | 8/2004 |
| JP | 2005-017758 | * | 1/2005 |
| JP | 2005-084434 | | 3/2005 |
| JP | 2005-234079 | | 9/2005 |

OTHER PUBLICATIONS

English translation of Japanese Publication No. JP 2005-017758, published Jan. 20, 2005.*

* cited by examiner

*Primary Examiner*—Sandra L Brase
(74) *Attorney, Agent, or Firm*—Oblon, Spivak, McClelland, Maier & Neustadt, P.C.

(57) ABSTRACT

An image forming apparatus includes a process cartridge with an image bearing member configured to bear an image on a surface thereof. A developing device is configured to develop the image formed on the image bearing member by using a developer accommodated in a chamber thereof. The developing device includes a developer bearing member configured to bear the developer on a surface thereof to transfer the developer to the image formed on the image bearing member. A conveying member is configured to agitate and convey the developer in the chamber to the developer bearing member. A regulating member held in contact with the developer brought up from the chamber onto the surface of the developing roller is configured to uniformly distribute the developer on the surface of the developer bearing member.

18 Claims, 5 Drawing Sheets

IMAGE FORMING APPARATUS, A PROCESS CARTRIDGE PROVIDED IN THE APPARATUS, AND A DEVELOPING DEVICE INCLUDED IN THE PROCESS CARTRIDGE OF THE APPARATUS

CROSS REFERENCE TO RELATED APPLICATIONS

The present application claims priority to Japanese patent application no. 2005-322188, filed in the Japan Patent Office on Nov. 7, 2005, the disclosure of which is incorporated by reference herein in its entirety.

BACKGROUND

1. Field of Invention

Exemplary aspects of the present invention relate to an image forming apparatus, a process cartridge provided in the image forming apparatus, and a developing device included in the process cartridge of the image forming apparatus. More particularly, exemplary aspects of the present invention relate to an image forming apparatus that employs a process cartridge having a developing device to effectively regulate a thickness of a developer brought up onto a developer bearing member.

2. Discussion of Related Art

Related art image forming apparatuses widely use a two-component developer including non-magnetic toner and magnetic carrier. In such an image forming apparatus, toner is supplied from a toner supplying device to a developing device in which at least one agitating member mounted therein agitates the toner. The agitated toner is conveyed to a developer bearing member for developing an electrostatic latent image formed on an image bearing member to a visible image.

When the amount of developer accommodated in the developing device is too small, the height of the developer becomes low and a sufficient amount of toner cannot be supplied to the developer bearing member. This may cause a nonuniformity in pitches of the agitating member to adversely affect a reproduced image.

Since recent related art developing devices include a developer container or a developer containing space to hold a developer therein, a sufficient amount of developer cannot be accommodated in such limited space.

A related art developing device is provided with a toner guide in the vicinity of a toner supplying opening of a developer container so that toner supplied from a toner supplying device can be guided to developer accommodated in an upstream area of a rotation direction of a toner conveying screw provided in the developer container.

When two conveying screws are used to convey developer or carrier in an axial direction thereof, the toner supplied from the toner supplying device is conveyed to slide over the developer or carrier due to a difference in specific gravity of the toner and the developer or carrier. This reduces or eliminates a disadvantage that the toner and the developer cannot sufficiently be mixed or agitated. The above-described operation can uniformly distribute the toner in the developer. Thereby the related art developing device forms images without density nonuniformity and toner scattering.

The above-described related art developing device, however, takes the toner in the developer into the developer container. In this case, the amount of toner received from the toner supplying device may vary depending on the height or pressure of the developer. Further, the height of the developer cannot be sufficiently maintained due to a gap between a developer bearing member and the toner conveying screw. The above-described conditions may induce a nonuniformity in pitches of the toner conveying screw.

SUMMARY

Exemplary aspects of the present invention have been made in view of the above-described circumstances.

Exemplary aspects of the present invention provide an image forming apparatus that can effectively regulate a thickness of a developer brought up onto a developer bearing member.

Other exemplary aspects of the present invention provide a process cartridge that can be employed in the above-described image forming apparatus.

Other exemplary aspects of the present invention provide a developing device that can be mounted in the above-described process cartridge of the above-described novel image forming apparatus.

In one exemplary embodiment, an image forming apparatus includes an image bearing member configured to bear an image on a surface thereof and a developing device configured to develop the image formed on the image bearing member by using a developer accommodated in a chamber thereof. The developing device includes a developer bearing member configured to bear the developer on a surface thereof to transfer the developer to the image formed on the image bearing member. A conveying member is configured to agitate and convey the developer in the chamber to the developer bearing member. A first regulating member is disposed above the conveying member, held in contact with the developer brought up from the chamber onto the surface of the developing roller, and configured to uniformly distribute the developer on the surface of the developer bearing member.

The above-described image forming apparatus may further include a second regulating member configured to regulate a thickness of a layer of the developer conveyed by the conveying member and uniformly distributed by the first regulating member onto the surface of the developer bearing member.

The conveying member may include a first conveying member configured to agitate and convey the developer from a first chamber to the developer bearing member, and a second conveying member disposed on the opposite side of the developer bearing member with respect to the first conveying member and configured to agitate and convey the developer from a second chamber to the first chamber.

The first regulating member may separately be detachable with respect to the developing device.

The above-described image forming apparatus may further include a carrier particle having a diameter in a range from approximately 20 μm to approximately 50 μm.

The above-described image forming apparatus may further include a carrier particle having a magnetic core and a resin coat film coating the magnetic core. The resin coat film includes a resin component obtained from a crosslinking reaction of a thermoplastic resin and a melanin resin and a charge controlling agent.

The above-described image forming apparatus may be configured to use toner obtained from at least one of an elongation and a crosslinking reaction of toner composition including a polyester prepolymer having a function group including a nitrogen atom, a polyester, a colorant, and a releasing agent in an aqueous medium under resin fine particles.

The above-described image forming apparatus may be configured to use toner having a volume-based average particle diameter from approximately 3 μm to approximately 8

μm and a distribution from approximately 1.00 to approximately 1.40. The distribution is defined by a ratio of the volume-based average particle diameter to a number-based average diameter.

The above-described image forming apparatus may be configured to use toner having a shape factor "SF-1" in a range from approximately 1.00 to approximately 1.80, and a shape factor "SF-2" in a range from approximately 100 to approximately 180.

The above-described image forming apparatus may be configured to use toner having a spindle outer shape, and a ratio of a major axis r1 to a minor axis r2 from approximately 0.5 to approximately 1.0 and a ratio of a thickness r3 to the minor axis r2 from approximately 0.7 to approximately 1.0, where r1≧r2≧r3.

The above-described image forming apparatus may further include a charging device configured to uniformly charge the surface of the image bearing member and a cleaning device configured to remove residual toner remaining on the surface of the image bearing member. In the above-described image forming apparatus, the developing device and one of the image bearing member, the charging member, and the cleaning member may be integrally mounted in a process cartridge.

In another exemplary embodiment, a process cartridge includes at least one of an image forming apparatus, a charging device, and a cleaning device and a developing device configured to develop the image formed on the image bearing member by using a developer accommodated in a chamber thereof. The developing device includes a developer bearing member configured to bear the developer on a surface thereof to transfer the developer to the image formed on the image bearing member. A first conveying member is configured to agitate and convey the developer from a first chamber of the chamber to the developer bearing member. A second conveying member is disposed on the opposite side of the developer bearing member with respect to the first conveying member and is configured to agitate and convey the developer from a second chamber of the chamber to the first chamber. A first regulating member is disposed above the conveying member, held in contact with the developer brought up from the chamber onto the surface of the developing roller and configured to uniformly distribute the developer on the surface of the developer bearing member. A second regulating member configured to regulate a thickness of a layer of the developer conveyed by the conveying member and uniformly distributed by the first regulating member onto the surface of the developer bearing member.

In another exemplary embodiment, a developing device includes a developer bearing member configured to bear a developer accommodated in a chamber of the developing device to transfer the developer to an image formed on an image bearing member. A first conveying member is configured to agitate and convey the developer from a first chamber of the chamber to the developer bearing member. A second conveying member is disposed on the opposite side of the developer bearing member with respect to the first conveying member and is configured to agitate and convey the developer from a second chamber of the chamber to the first chamber. A first regulating member is disposed above the conveying member and held in contact with the developer brought up from the chamber onto the surface of the developing roller. The first regulating member is configured to uniformly distribute the developer on the surface of the developer bearing member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
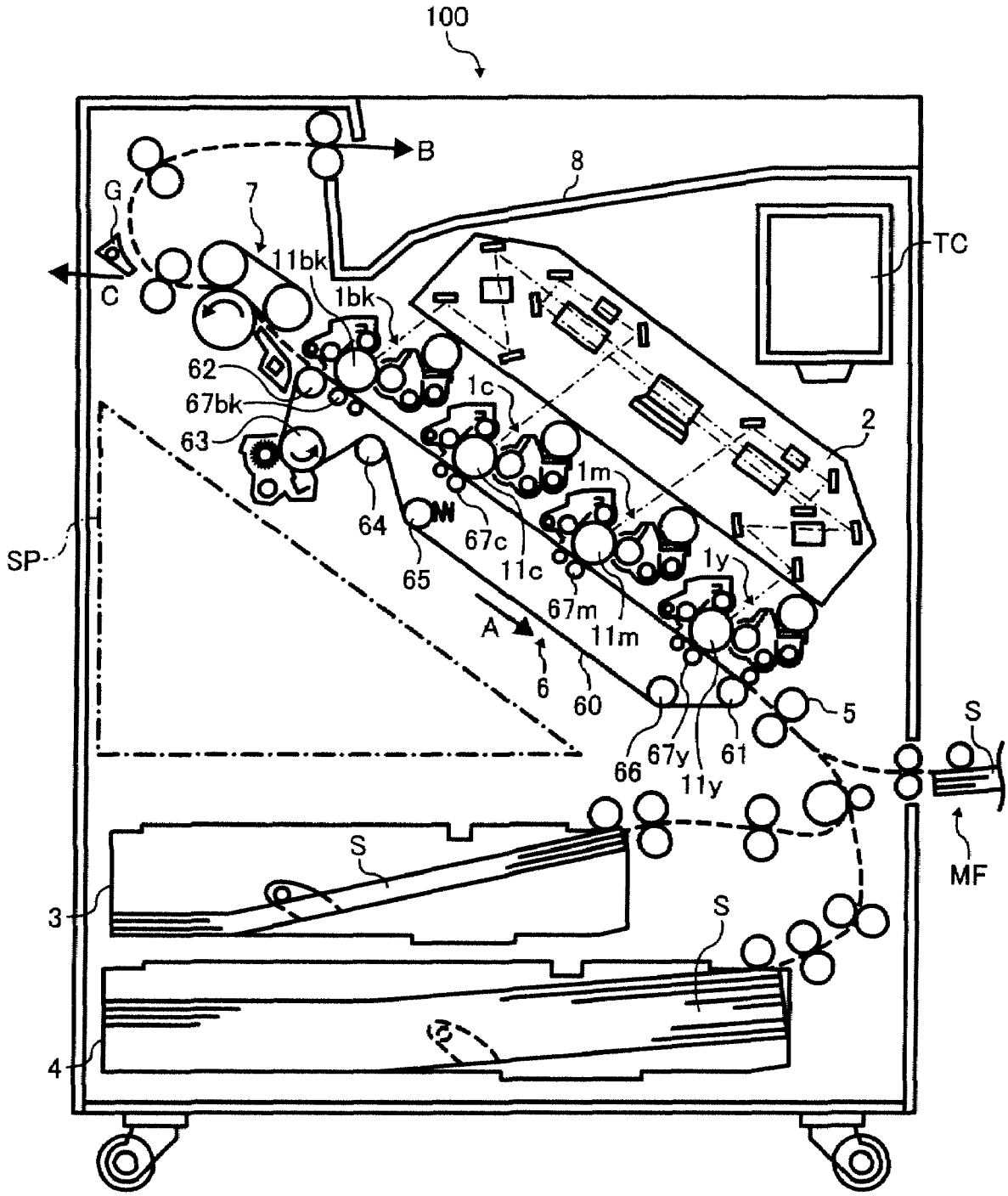
FIG. 1 is a schematic structure of a laser printer according to an exemplary embodiment of the present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, exemplary embodiments of the present invention are described.

It is important to note that, in the exemplary embodiments hereinafter described, an image forming apparatus corresponds to a laser printer 100. An image bearing member corresponds to photoconductive drums 11y, 11m, 11c, and 11bk. A developing device corresponds to a developing device 400 or 40. A developer bearing member corresponds to a developing roller 42. A conveying member corresponds to a first conveying screw 43 and a second conveying screw 44. A first regulating member corresponds to a developer distribution regulating member 50. A second regulating member corresponds to a regulating blade 45. A toner density sensor corresponds to a magnetic permeability sensor 46. A charging device corresponds to a charging device 20. A cleaning device corresponds to a cleaning device 70.

Figure 2:
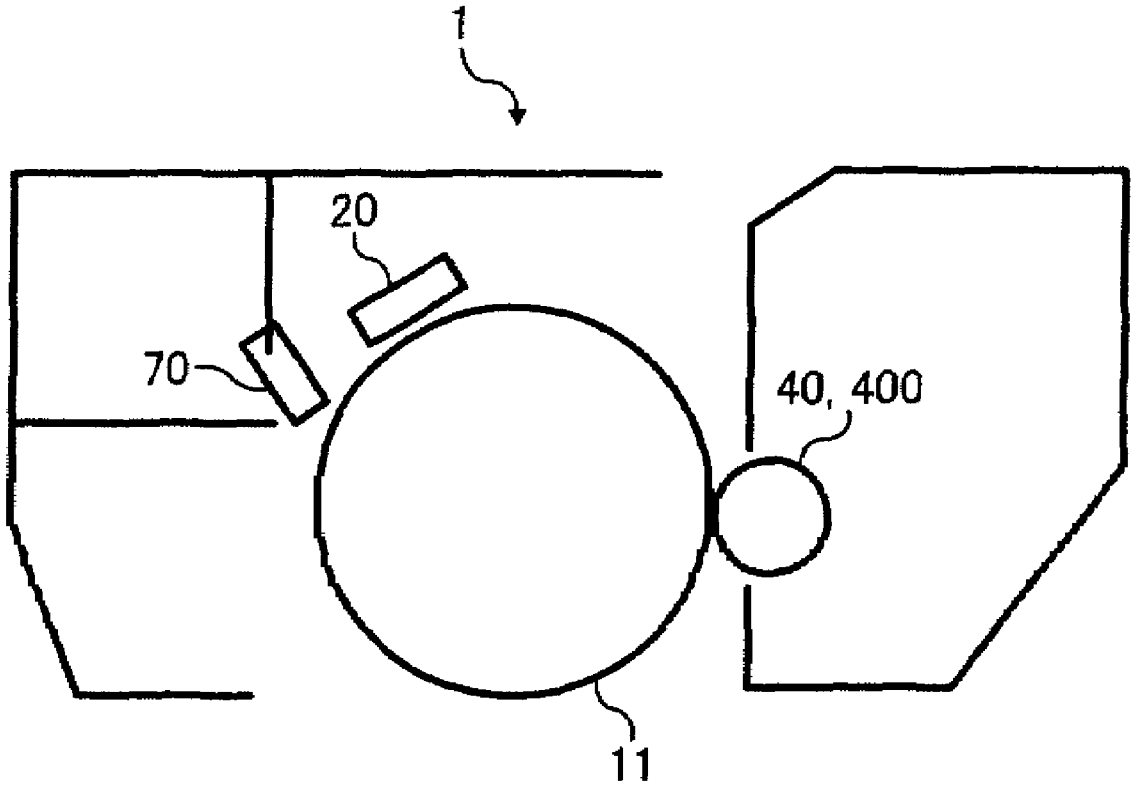
FIG. 2 is an example of a process cartridge provided in the laser printer of FIG. 1, according to the exemplary embodiment of the present invention.

Referring to FIGS. 1 and 2, a schematic structure of a laser printer 100 serving as a color image forming apparatus according to an exemplary embodiment of the present invention is described.

The laser printer 100 of FIG. 1 is an electrophotographic printer employing a direct transfer method. The laser printer 100 includes four image forming stations or units 1y, 1m, 1c, and 1bk, an optical writing device 2, sheet feeding cassettes 3 and 4, a pair of registration rollers 5, a transfer device 6, a fixing device 7, a sheet discharging tray 8, a manual sheet feeder MF, and a toner cartridge TC. The laser printer 100 further includes a toner collecting bottle (not shown), a duplex and reverse unit (not shown), a power supply unit (not shown) and so forth in a space SP indicated by an alternate long and short dash line in FIG. 1.

The four image forming stations or units 1y, 1m, 1c, and 1bk are disposed in a stepped manner. The four image forming stations or units 1y, 1m, 1c, and 1bk include photoconductive drums 11y, 11m, 11c, and 11bk, respectively, for forming respective single color toner images, for example, yellow toner images, magenta toner images, cyan toner images, and black toner images.

The image forming stations 1y, 1m, 1c, and 1bk are arranged such that respective rotational axes of the photoconductive drums 11y, 11m, 11c, and 11bk become parallel with each other and the adjacent photoconductive drums 11y, 11m, 11c, and 11bk have a predetermined pitch or interval with each other.

The optical writing device 2 includes a light source (not shown), a polygon mirror (not shown), a f-theta lens (not shown), and other lenses and mirrors (not shown). The optical writing device 2 may employ a slit exposure, a laser beam scanning exposure, or the like. In this case, the optical writing device 2 emits respective laser light beams to irradiate respective surfaces of the photoconductive drums 11y, 11m, 11c, and 11bk so that respective electrostatic latent images are formed on the respective surfaces of the photoconductive drums 11y, 11m, 11c, and 11bk.

The four image forming stations or units 1y, 1m, 1c, and 1bk include other image forming components disposed around each of the image forming stations 1y, 1m, 1c, and 1bk. Each of the image forming stations or units 1y, 1m, 1c, and 1bk can serve as a process cartridge in which a corresponding one of the photoconductive drums 11y, 11m, 11c, and 11bk and other image forming components are integrally mounted therein.

FIG. 2 depicts a schematic example of one image forming station according to an exemplary embodiment of the present invention.

The image forming station of FIG. 2 can be applied to any of the image forming stations 1y, 1m, 1c, and 1bk. Because the image forming stations and components indicated by "y", "m", "c", and "bk" used for the image forming operations have similar structures and functions, except that respective toner images formed thereon are of different colors which are yellow, magenta, cyan, and black toners, the discussion in FIG. 2 uses reference numerals for specifying components of the laser printer 100 without the suffixes.

The image forming station or process cartridge 1 of FIG. 2 includes the photoconductive drum 11, a charging device 20, a developing device 40, and a cleaning device 70.

The charging device 20 uniformly charges a surface of the photoconductive drum 11.

The developing device 40 develops an electrostatic latent image formed by the optical writing device 2 on the surface of the photoconductive drum 11 into a visible color toner image.

The cleaning device 70 removes residual toner remaining on the surface of the photoconductive drum 11 after the color toner image has been transferred onto the surface of the transfer sheet S.

The process cartridge 1 may include the developing device 40 and one of the photoconductive drum 11, the charging device 20, and the cleaning device 70. Further, the process cartridge 1 may be detachable with respect to the laser printer 100.

Returning back to FIG. 1, the transfer device 6 includes a transfer belt 60.

The transfer belt 60 is extendedly supported by or is spanned around a plurality of supporting rollers 61, 62, 63, 64, 65, and 66 in a form of an endless belt moving in a direction indicated by arrow A in FIG. 1. The transfer belt 60 is sandwiched by transfer rollers 67y, 67m, 67c, and 67bk that face the photoconductive drums 11y, 11m, 11c, and 11bk, respectively.

The transfer belt 60 carries the transfer sheet S so that the transfer sheet S passes in the order of the transfer nip formed between the photoconductive drum 11y and the transfer roller 67y, the transfer nip formed between the photoconductive drum 11m and the transfer roller 67m, the transfer nip formed between the photoconductive drum 11c and the transfer roller 67c, and the transfer nip formed between the photoconductive drum 11bk and the transfer roller 67bk.

The sheet feeding cassettes 3 and 4 and the pair of registration rollers 5 form a sheet feeding mechanism.

The sheet feeding cassettes 3 and 4 respectively accommodate transfer sheets as recording media, including a transfer sheet S.

The pair of registration rollers 5 stops and forwards the transfer sheet S conveyed from the sheet feeding cassettes 3 and 4 in synchronization with a movement of the sheet transfer belt 60.

The fixing device 7 fixes an overlaid color toner image or a full-color image transferred onto a surface of the transfer sheet S by applying heat and pressure.

The sheet discharging tray 8 receives the transfer sheet S fixed by the fixing device 7.

The manual sheet feeder MF provides a different sheet feeding mechanism to feed the transfer sheet S therefrom.

The toner cartridge TC serves as a toner supplying device and may include a plurality of toner supplying devices accommodating respective toners of different colors.

A dotted line in FIG. 1 shows a conveying path of a transfer sheet S. The transfer sheet S conveyed from one of the sheet feeding cassettes 3 and 4 or the manual sheet feeder MF is guided by a sheet conveying guide (not shown) and conveying rollers (not shown) to the pair of registration rollers 5 at which the transfer sheet S is stopped temporarily. At a predetermined timing, the pair of registration rollers 5 delivers the transfer sheet S to the sheet conveying belt 60 so that the transfer sheet S can sequentially pass through the respective transfer nips formed between the photoconductive drums 11y, 11m, 11c, and 11bk and the transfer rollers 67y, 67m, 67c, and 67bk.

The respective toner images formed on the photoconductive drums 11y, 11m, 11c, and 11bk are sequentially overlaid on the transfer sheet S at the respective transfer nips. To transfer the respective toner images to the transfer sheet S, a transfer electric field and a nip pressure are applied. Thus, a full-color toner image may be formed on the transfer sheet S.

After transferring the respective toner images onto the transfer sheet S, residual toners and residual electric charges remaining on the respective surfaces of the photoconductive drums 11y, 11m, 11c, and 11bk are removed therefrom to prepare for the next image forming operation.

After the transfer sheet S having the full-color toner image on one surface thereof has been fixed by the fixing unit 7, the transfer sheet S is conveyed to a first sheet discharging direction B or a second sheet discharging direction C according to a movement of a sheet direction switching guide G.

When the transfer sheet S is conveyed to the first sheet discharging direction B, the transfer sheet S may be discharged onto the sheet discharging tray 8 and may be stacked with the printed surface facing down or in a face-down manner.

When the transfer sheet S is conveyed to the second sheet discharging direction C, the transfer sheet S may be conveyed to a sheet finishing apparatus (not shown), for example a sorter, stacker, and so forth, that may be connected with the laser printer 100 or may be returned to the pair of registration rollers 5 via a switch back unit (not shown) for duplex printing.

Figure 3:
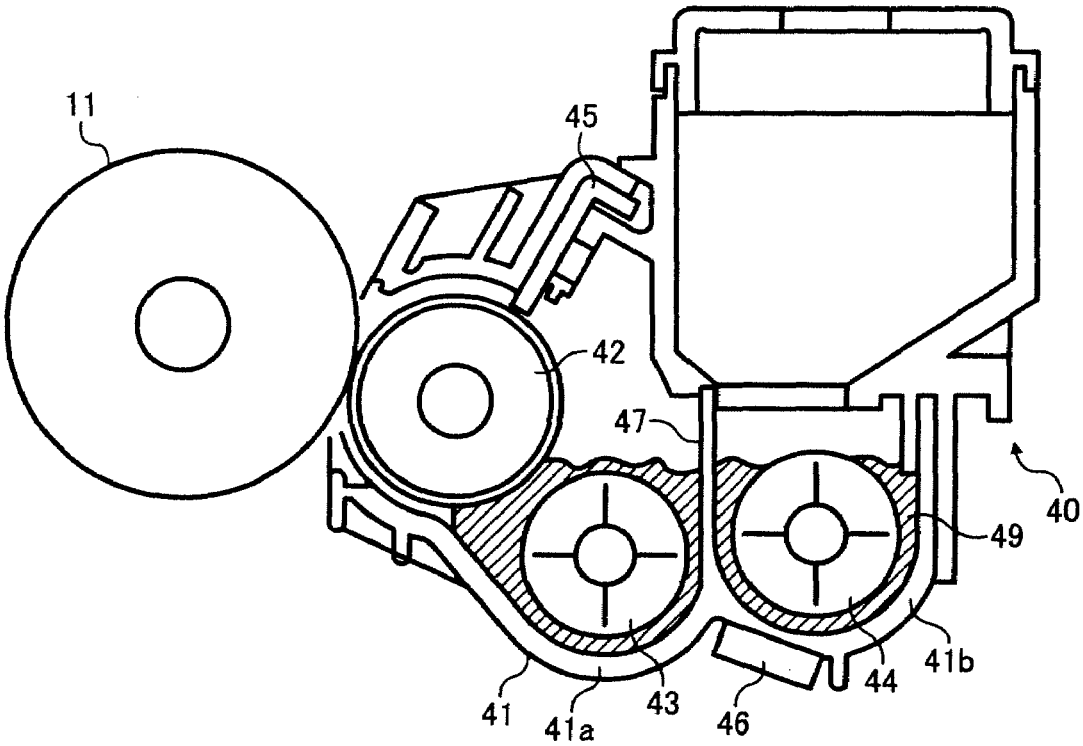
FIG. 3 is an example of a developing device provided in the process cartridge of FIG. 2.

Referring to FIG. 3, a schematic structure of the developing device 40 is described.

The developing device 40 includes a developing roller 42, first and second conveying screws 43 and 44, a regulating blade 45, and a toner density sensor or T-sensor 46 in a casing 41 having an opening (not shown) thereon.

The casing 41 contains a two-component developer 49 including magnetic carriers and negatively charged toner.

The developing roller 42 is arranged in the vicinity of the corresponding photoconductive drum 11 or in contact with the surface of the corresponding photoconductive drum 11 while a portion thereof is exposed to the corresponding photoconductive drum 11 from the opening of the casing 41.

The first and second conveying screws 43 and 44 agitate and convey the two-component developer 49 to frictionally charge the two-component developer 49. The charged developer 49 is conveyed to a surface of the developing roller 42 to form a layer thereof.

The regulating blade 45 regulates the height or thickness of the layer of the developer 49 on the surface of the developing roller 42 before the developer 49 is conveyed to a developing area formed between the developing roller 42 and the photoconductive drum 11. In the developing area, the developer 49 is transferred to the photoconductive drum 11 to adhere to the electrostatic latent image formed on the photoconductive drum 11. Thus, the electrostatic latent image is developed into a visible toner image. After consuming the toner as described above, the developer 49 is returned to the casing 41 along with the rotations of the developing roller 42.

Specifically, the two-component developer 49 is conveyed in the developing unit 40 as described below.

The developing device 40 further includes a partition wall 47 between the first conveying screw 43 and the second conveying screw 44 for dividing the casing 41 into two chambers, which are first and second chambers 41*a* and 41*b*.

The first chamber 41 a includes the developing roller 42, the first conveying screw 43 and so forth, and the second chamber 41*b* includes the second conveying screw 44 and so forth.

The first conveying screw 43 is rotated by a driving unit (not shown) to supply the developer 49 in the first chamber 41*a* from a front side to a far side in a direction perpendicular to the sheet surface of FIG. 3, to the developing roller 42. When the first conveying screw 43 has conveyed the developer 49 up to an end portion of the first chamber 41*a*, the developer 49 passes through an opening (not shown) mounted on the partition wall 47 and enters into the second chamber 41*b*.

The second conveying screw 44 provided in the second chamber 41*b* is rotated by a driving unit (not shown) to convey the two-component developer 49 from the first chamber 41*a* in a rotation direction opposite to the rotation direction of the first conveying screw 43. When the second conveying screw 44 has conveyed the developer 49 up to an end portion of the second chamber 41*b*, the developer 49 passes through a different opening (not shown) mounted on the partition wall 47 and returns to the first chamber 41*a*.

The T-sensor 46 serves as a magnetic permeability sensor and is disposed in the vicinity of the center of a bottom plate of the second chamber 41*b*. The T-sensor 46 detects magnetic permeability of the two-component developer 49 passing thereover and outputs a voltage value corresponding to the detection result. The magnetic permeability of the two-component developer 49 is correlative with toner density, which means that the T-sensor 46 outputs a voltage value according to the toner density.

The output voltage is sent to a controller (not shown). The controller includes a random access memory or RAM (not shown) to store "Vtref" data that is a target value of the output voltage from the T-sensor 46. The RAM of the controller also stores "Vtref" data of T-sensors (not shown) mounted on the other developing devices in the laser printer 100. The Vtref data is used to control the toner cartridge TC (not shown). Specifically, the controller controls the toner cartridge TC to supply toner into the second chamber 41*b* so that the output voltage value of the T-sensor 46 can become close to the value of the Vtref data. With the above-described toner supplying operation, the toner density of the two-component developer 49 in the developing device 40 can be maintained within a predetermined range. Respective toner supplying operations same as the above-described one may be performed for respective developing devices provided to the other process cartridges.

Figure 4:
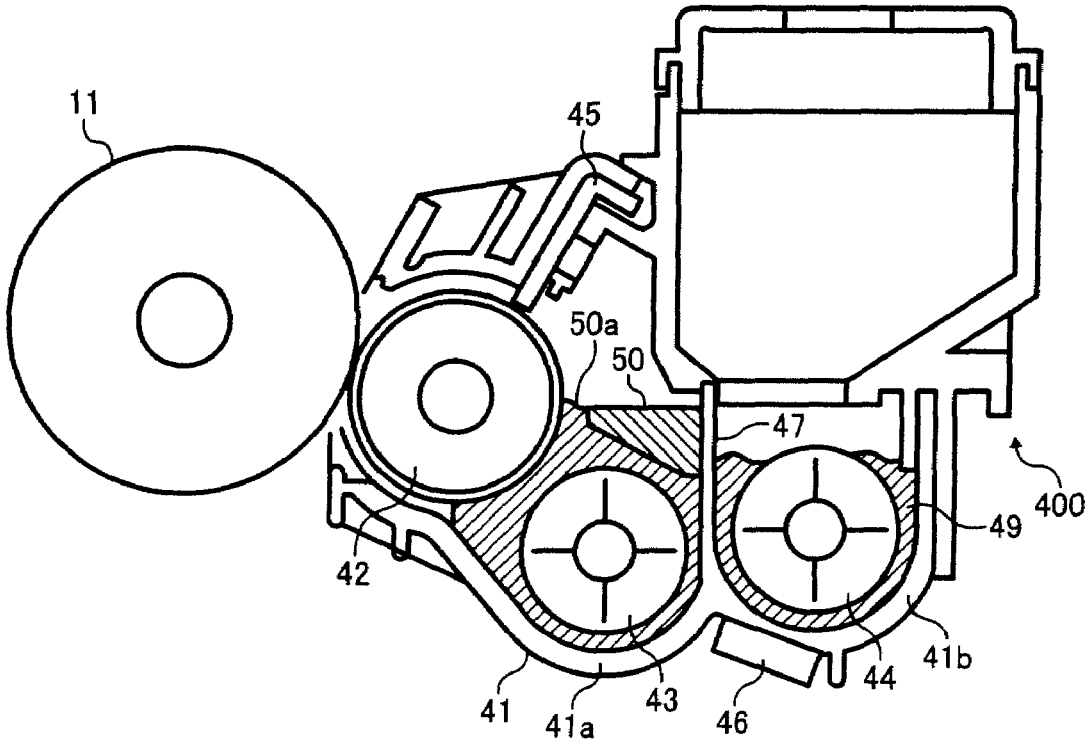
FIG. 4 is a schematic structure of a different developing device provided in the process cartridge of FIG. 2, including a regulating member for a layer thickness, according to the exemplary embodiment of the present invention.

Referring to FIG. 4, a schematic structure of a developing device 400 according to the exemplary embodiment of the present invention is described.

The structure of the developing device 400 of FIG. 4 is substantially similar to the structure of the developing device 40 of FIG. 3. Except, the developing device 400 includes a developer distribution regulating member 50 that can regulate the layer thickness of the two-component developer 49 that is brought up from the first chamber 41 a onto the surface of the developing roller 42.

The developer distribution regulating member 50 is disposed above the upper portion of the first conveying screw 43 and is held in contact with the developer 49 so as to evenly bring the developer 49 onto the developing roller 42.

The developing device 40 without the developer distribution regulating member 50 has the first conveying screw 43, the upper surface of the developer 49, and a surface of the developing roller 42 disposed close to each other. With this structure, when the level of the developer 49 in the first chamber 41*a* is not sufficient for the first conveying screw 43 to bring up the developer 49 onto the developing roller 42, the layer thickness of the developer 49 conveyed to the surface of the developing roller 42 may become uneven. Specifically, the amount of developer 49 carried by the developing roller 42 may vary between a portion close to a screw portion of the first conveying screw 43 and a different portion other than the portion close to the screw portion, thereby the layer thickness of the developer 49 brought to the developing roller 42 may become uneven.

In the developing device 400 of FIG. 4, on the contrary, the developer distribution regulating member 50 may raise the level of the developer 49, thereby an adverse affect exerted by the screw portion of the first conveying screw 43 can be reduced or avoided. Even if the first conveying screw 43 still causes the unevenness of the layer thickness, the developer distribution regulating member 50 may be arranged to be held in contact with the developer 49 brought up onto the developing roller 42 at a closest contact portion 50*a* thereof with respect to the developing roller 42. With the above-described structure, the developer distribution regulating member 50 can uniformly distribute the developer 49 on the surface of the developing roller 42. Thereby, non-uniformity in the layer thickness of the developer 49 or non-uniformity of developer distribution due to screw pitch can be reduced or eliminated when bringing up the developer 49 onto the developing roller 42.

As previously described, the developer distribution regulating member 50 is disposed above the upper portion of the first conveying screw 43. Specifically, the developer distribution regulating member 50 is mounted onto the partition wall 47 of the casing 41 by a double-stick tape. Therefore, a user or users can voluntarily select the optimal developer distribution regulating member 50 to optimize a gap of the closest contact portion 50*a* with respect to the developing roller 42 according to the amount of the developer 49.

With the developing device 400 including the developer distribution regulating member 50, insufficient conveyance of the developer 49 to an upward direction or non-uniformity in screw pitch caused by the first conveying screw 43 can be reduced or eliminated by the developer distribution regulating member 50 and the developer 49 can be thoroughly agitated at the developer distribution regulating member 50. Thereby, the developing device 400 can serve as a developing device with high reliability and less or no non-uniformity in screw pitch.

Further, the developer distribution regulating member 50 is separately detachable from the developing device 400. With the above-described structure, the developer distribution regulating member 50 can have more flexibility in its shape and can easily be optimized. Further, the developing device 400 includes no undercut when the lower portion of the casing 41 is molded. Thereby, the structure of the developing device 400 may be made simple and can reduce the costs.

Further, the developing device 400 includes the two-component developer 49 including toner and carriers. Each of the carriers nay have a diameter in a range from approximately 20 μm to approximately 50 μm. That is, the diameter of the carrier particle may be 20 μm or greater and 50 μm or smaller. This structure can produce images having good dot reproducibility. By making the carrier to have such a small diameter in the above-described range, the width of fibers or carrier chains of each developer 49 may uniformly be reduced to become thinner. The thin carrier chains can receive and transfer toner with higher density.

Further, the density of carrier chains per a predetermined area on the developing roller 42 or a developing sleeve may also increase. With the increased density of the carrier chains, toner received from the toner cartridge TC can be transferred onto the latent image formed on the surface of the photoconductive drum 11 closer with less or no space between toner particles. Thereby, images having good dot reproducibility can be obtained.

When a carrier particle having a diameter greater than 50 μm is compared with a different carrier particle having a smaller diameter but a same amount as the above-described carrier particle, the carrier particle having the diameter greater than 50 μm may have a smaller total surface area, which can reduce the total amount of toner with respect to one carrier particle and can further reduce the toner density. The second conveying screw 43 can convey more toner to maintain the developing ability so as to avoid the reduction of the toner density. However, this action may easily cause toner adhesion.

When a carrier particle has a diameter smaller than 20 μm, magnetic force holding power may decrease, which may cause carrier scattering to increase the adhesion of carrier to the photoconductive drum 11. Therefore, it is preferable that the diameter of a carrier particle be 20 μm or greater.

However, high dot reproducibility and/or high image quality may induce high reproducibility of uneven development.

By reducing the diameter of a carrier particle as described above, images having good dot reproducibility can be obtained and a developing device, such as the developing device 400 according to the exemplary embodiment of the present invention, can reduce uneven development.

Figure 5:
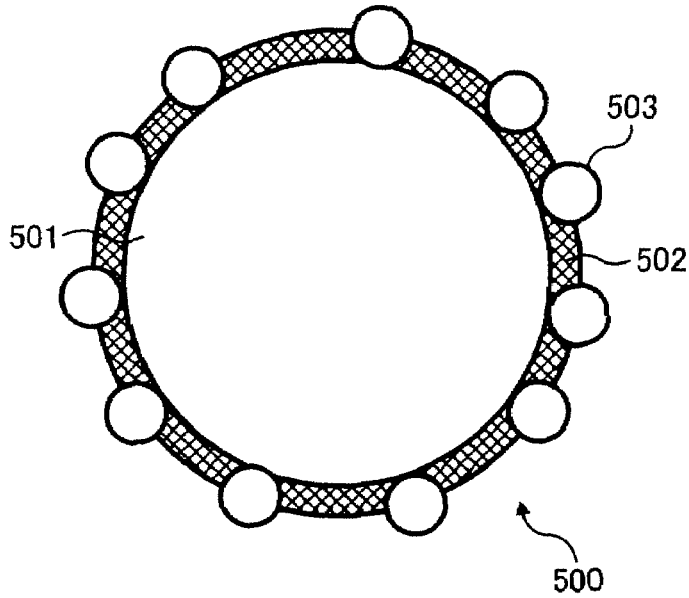
FIG. 5 is a schematic structure of a carrier particle used in the developing device of FIG. 4.

Referring to FIG. 5, a schematic structure of a carrier particle 500 used in the developing device 400 according to the exemplary embodiment of the present invention is described.

The carrier particle 500 includes a magnetic core 501 formed by a ferrite material that is coated by a resin coat film 502. The resin coat film 502 includes a resin component obtained from a crosslinking reaction of a thermoplastic resin, such as an acrylic resin, and a melanin resin and a charge controlling agent.

Specifically, the resin coat film 502 may be a coat film that has elasticity and high adhesive force and covers the surface of the magnetic core 501. The resin coat film 502 also includes particles having a diameter greater than the thickness of the resin coat film 502. The particles may include alumina particles 503 that are adhered by high adhesive force of the resin coat film 502.

While a carrier particle has a structure to gradually pare a hard coating film that covers a surface thereof for keeping its long life, the carrier 501 depicted in FIG. 5 may have a different structure in which the adhesive force of the resin coat film 502 can absorb shock or impact so as to reduce the change of a film thickness. Further, by scattering the alumina particles 503 having a diameter greater than the thickness of the resin coat film 502 on the surface of the carrier 501, shock or impact to the resin coat film 502 may be reduced or prevented and can remove spent toner from the carrier 501.

Thus, the carrier 500 of FIG. 5 can reduce the film thickness change or reduction of the resin coat film 502 and the amount of spent toner, thereby the carrier 500 can live longer when compared with a background carrier. With the carrier 500, the stable amount of conveyance of the developer 49, which is the stable quality of the developer 49, can be maintained over a long period of time. The developer 49 having a long life can reduce maintenance load to a user and production cost to manufacturers.

A toner for use in an image forming apparatus according to the present invention is produced through bridge reaction and/or elongation reaction of a liquid toner material in aqueous solvent. Here, the liquid toner material is generated by dispersing polyester prepolymer including an aromatic group having at least a nitrogen atom, polyester, a coloring agent, and a release agent in organic solvent. In the following, toner constituents and a toner manufacturing method are described in detail.

Polyester is produced by the condensation polymerization reaction of a polyhydric alcohol compound with a polyhydric carboxylic acid compound.

A polyalcohol (PO) compound may be divalent alcohol (DIO) and tri- or more valent polyalcohol (TO). Only DIO or a mixture of DIO and a small amount of TO may be used. The divalent alcohol (DIO) may be alkylene glycol (ethylene glycol, 1,3-propylene glycol, 1,4-butanediol, 1,6-hexanediol or the like), alkylene ether glycol (diethylene glycol, triethylene glycol, dipropyrene glycol, polyethylene glycol, polypropylene glycol, polytetramethylene ether glycol or the like), alicyclic diol (1,4-cyclohexane dimethanol, hydrogenated bisphenol A or the like), bisphenols (bisphenol A, bisphenol F, bisphenol S or the like), alkylene oxide adducts of above-mentioned alicyclic diols (ethylene oxide, propylene oxide, butylene oxide or the like), and alkylene oxide adducts of the above-mentioned bisphenols (ethylene oxide, propylene oxide, butylene oxide or the like).

Alkylene glycol having 2-12 carbon atoms and alkylene oxide adducts of bisphenols may be used. In particular, the alkylene glycol having 2-12 carbon atoms and the alkylene oxide adducts of bisphenols may be used together. Tri- or more valent polyalcohol (TO) may be tri- to octa or more valent polyaliphatic alcohols (glycerin, trimethylolethane, trimethylol propane, pentaerythritol, sorbitol or the like), tri- or more valent phenols (trisphenol PA, phenol novolac, cresol novolac or the like), and alkylene oxide adducts of tri- or more valent polyphenols.

The polycarboxylic acid (PC) maybe divalent carboxylic acid (DIC) and tri- or more valent polycarboxylic acid (TC). Only DIC or a mixture of DIC and a small amount of TC may be used. The divalent carboxylic acid (DIC) may be alkylene dicarboxylic acid (succinic acid, adipic acid, sebacic acid or the like), alkenylene dicarboxylic acid (maleic acid, fumaric acid or the like), and aromatic dicarboxylic acid (phthalic acid, isophthalic acid, terephthalic acid, naphthalene dicarboxylic acid or the like). Alkenylene dicarboxylic acid having 4-20 carbon atoms and aromatic dicarboxylic acid having 8-20 carbon atoms may be used. Tri- or more valent polycarboxylic acid may be aromatic polycarboxylic acid having 9-20 carbon atoms (trimellitic acid, pyromellitic acid or the like). Here, the polycarboxylic acid (PC) may be reacted to the polyalcohol (PO) by using acid anhydrides or lower alkyl ester (methylester, ethylester, isopropylester or the like) of the above-mentioned materials.

A ratio of the polyalcohol (PO) and the polycarboxylic acid (PC) is normally set between 2/1 and 1/1 as an equivalent ratio [OH]/[COOH] of a hydroxyl group [OH] and a carboxyl group [COOH]. The ratio may be from 1.5/1 through 1/1. In particular, the ratio may be between 1.3/1 and 1.02/1.

In the condensation polymerization reaction of a polyhydric alcohol (PO) with a polyhydric carboxylic acid (PC), the polyhydric alcohol (PO) and the polyhydric carboxylic acid (PC) are heated to a temperature from 150° C. to 280° C. in the presence of a known esterification catalyst, e.g., tetrabutoxy titanate or dibutyltineoxide. The generated water is distilled off with pressure being lowered, if necessary, to obtain a polyester resin containing a hydroxyl group. The hydroxyl value of the polyester resin may be 5 or more while the acid value of polyester is usually between 1 and 30, and may be between 5 and 20. When a polyester resin having such an acid value is used, the residual toner is easily negatively charged. In addition, the affinity of the toner for recording paper can be enhanced, resulting in enhancement of low temperature fixability of the toner. However, a polyester resin with an acid value above 30 can adversely affect stable charging of the residual toner, particularly when the environmental conditions vary.

The weight-average molecular weight of the polyester resin is from 10,000 to 400,000, and may be from 20,000 to 200,000. A polyester resin with a weight-average molecular weight between 10,000 lowers the offset resistance of the residual toner while a polyester resin with a weight-average molecular weight above 400,000 lowers the temperature fixability.

A urea-modified polyester may be included in the toner in addition to unmodified polyester produced by the above-described condensation polymerization reaction. The urea-modified polyester is produced by reacting the carboxylic group or hydroxyl group at the terminal of a polyester obtained by the above-described condensation polymerization reaction with a polyisocyanate compound (PIC) to obtain polyester prepolymer (A) having an isocyanate group, and then reacting the prepolymer (A) with amines to crosslink and/or extend the molecular chain.

Specific examples of the polyisocyanate (PIC) include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; 10 aromatic diisocyanate such as tolylenedisocyanate and diphenylmethanediisocyanate; aroma aliphatic diisocyanate such as α α α α -te-tramethylxylylenediisocyanate; isocyanurate; the above-mentioned polyisocyanate blocked with phenol derivatives, oxime and caprolactam; and their combinations.

The polyisocyanate (PIC) is mixed with a polyester such that the equivalent ratio ([NCO]/[OH]) between the isocyanate group [NCO] of the polyisocyanate (PIC) and the hydroxyl group [OH] of the polyester may typically be from 5/1 to 1/1, from 4/1 to 1.2/1 and from 2.5/1 to 1.5/1. When [NCO]/[OH] is greater than 5, low temperature fixability of the resultant toner deteriorates. When the molar ratio of [NCO] is less than 1, the urea content in the resultant modified polyester decreases and hot offset resistance of the resultant toner deteriorates.

The content of the constitutional unit obtained from a polyisocyanate (PIC) in the polyester prepolymer (A) may be from 0.5% to 40% by weight, from 1 to 30% by weight and from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) may be at least 1, from 1.5 to 3 on average, and from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of amino acid (B5) are aminopropionic acid and caproic acid. Specific examples of the blocked amines (B6) include ketimine compounds which are prepared by reacting one of the amines B1-B5 mentioned above with a ketone, such as acetone, methyl ethyl ketone and methyl isobutyl ketone; oxazoline compounds, etc. Among these compounds, diamines (B1) and mixtures in which a diamine is mixed with a small amount of a polyamine (B2) may be used.

The mixing ratio (i.e., a ratio [NCO]/[NHx]) of the content of the prepolymer (A) having an isocyanate group to the amine (B) may be from 1/2 to 2/1, from 1.5/1 to 1/1.5 and from 1.2/1 to 1/1.2. When the mixing ratio is greater than 2 or less than 1/2, molecular weight of the urea-modified polyester decreases, resulting in deterioration of hot offset resistance of the resultant toner.

Suitable polyester resins for use in the toner of an exemplary embodiment of the present invention include a urea-modified polyesters (i). The urea-modified polyester (i) may include a urethane bonding as well as a urea bonding. The molar ratio (urea/urethane) of the urea bonding to the urethane bonding may be from 100/0 to 10/90, from 80/20 to 20/80 and from 60/40 to 30/70. When the molar ratio of the urea bonding is less than 10%, hot offset resistance of the resultant toner deteriorates.

The urea modified polyester is produced by, for example, a one-shot method. Specifically, a polyhydric alcohol (PO) and a polyhydric carboxylic acid (PC) are heated to a temperature of 150° C. to 280° C. in the presence of the known esterification catalyst, e.g., tetrabutoxy titanate or dibutyltineoxide to be reacted. The resulting water is distilled off with pressure being lowered, if necessary, to obtain a polyester containing a hydroxyl group. Then, a polyisocyanate (PIC) is reacted with the polyester obtained above a temperature of from 40° C. to 140° C. to prepare a polyester prepolymer (A) having an isocyanate group. The prepolymer (A) is further reacted with an amine (B) at a temperature of from 0° C. to 140° C. to obtain a urea-modified polyester.

At the time of reacting the polyisocyanate (PIC) with a polyester and reacting the polyester prepolymer (A) with the amines (B), a solvent may be used, if necessary. Specific examples of the solvent include solvents inactive to the isocyanate (PIC), e.g., aromatic solvents such as toluene, xylene; ketones such as acetone, methyl ethyl ketone, methyl isobutyl ketone; esters such as ethyl acetate; amides such as dimethyl formamide, dimethyl acetatamide; and ethers such as tetrahydrofuran.

A reaction anticatalyst can optionally be used in the crosslinking and/or elongation reaction between the polyester prepolymer (A) and amines (B) to control a molecular weight of the resultant urea-modified polyesters, if desired. Specific examples of the reaction anticatalyst include monoamines such as diethyl amine, dibutyl amine, butyl amine and lauryl amine, and blocked amines, i.e., ketimine compounds prepared by blocking the monoamines described above.

The weight-average molecular weight of the urea-modified polyester may be not less than 10,000, from 20,000 to 10,000,000 and from 30,000 to 1,000,000. A molecular weight of less than 10,000 deteriorates the hot offset resisting property. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight may be from 2,000 to 15,000, from 2,000 to 10,000, and from 2,000 to 8,000. When the number-average molecular weight is greater than 20,000, the low temperature fixability of the resultant toner deteriorates, and in addition the glossiness of full color images deteriorates.

In exemplary embodiments of the present invention, not only the urea-modified polyester alone but also the unmodified polyester resin can be included with the urea-modified polyester. A combination thereof enhances low temperature fixability of the resultant toner and glossiness of color images produced by the full-color image forming apparatus 100. It is noted that the unmodified polyester may contain polyester modified by a chemical bond other than the urea bond.

The urea-modified polyester may at least partially mix with the unmodified polyester resin to enhance the low temperature fixability and hot offset resistance of the resultant toner. Therefore, the urea-modified polyester may have a structure similar to that of the unmodified polyester resin.

A mixing ratio between the urea-modified polyester and polyester resin may be from 20/80 to 95/5 by weight, from 70/30 to 95/5 by weight, from 75/25 to 95/5 by weight, and from 80/20 to 93/7 by weight. When the weight ratio of the urea-modified polyester is less than 5%, the hot offset resistance deteriorates, and in addition, it is difficult to impart a good combination of high temperature preservability and low temperature fixability of the toner.

The toner binder may have a glass transition temperature (Tg) of from 45° C. to 65° C., from 45° C. to 60° C. When the glass transition temperature is less than 45° C., the high temperature preservability of the toner deteriorates. When the glass transition temperature is higher than 65° C., the low temperature fixability deteriorates.

Since the urea-modified polyester can exist on the surfaces of the mother toner particles, the toner of an exemplary embodiment of the present invention has better high temperature preservability than related art toners including a polyester resin as a binder resin even though the glass transition temperature is low.

Colorant

Suitable colorants for use in the toner of an exemplary embodiment of the present invention include any suitable colorant including related art dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, 25 Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroanilne red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner may be from 1 to 15% by weight, and from 3 to 10 % by weight, based on the total weight of the toner.

The colorants mentioned above for use in the present invention can be used as master batch pigments by being combined with a resin.

The examples of binder resins to be kneaded with the master batch or used in the preparation of the master batch are styrenes like polystyrene, poly-p- chlorostyrene, polyvinyl toluene and polymers of their substitutes, or copolymers of these with a vinyl compound, polymethyl metacrylate, polybutyl metacrylate, polyvinyl chloride, polyvinyl acetate, polyethylene, polypropylene, polyester, epoxy resins, epoxy polyol resins, polyurethane, polyamides, polyvinyl butyral, polyacrylic resins, rosin, modified rosin, terpene resins, aliphatic and alicyclic hydrocarbon resins, aromatic petroleum resins, chlorinated paraffins, paraffin wax etc. which can be used alone or in combination.

Charge Controlling Agent

Specific examples of the charge controlling agent include known charge controlling agents such as Nigrosine dyes, triphenylmethane dyes, metal complex dyes including chromium, chelate compounds of molybdic acid, Rhodaminedyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative) PR, COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner may be used.

The content of the charge controlling agent is determined depending on the species of the binder resin used, whether or not an additive is added, the toner manufacturing method (such as dispersion method) used, and is not particularly limited. However, the content of the charge controlling agent is typically from 0.1 to 10 parts by weight, and may be from 0.2 to 5 parts by weight, per 100 parts by weight of the binder resin included in the toner. When the content is too high, the toner has too large a charge quantity. Consequently, the electrostatic force of a developing roller attracting the toner increases, resulting in deterioration of the fluidity of the toner and decrease of the image density of toner images.

Releasing Agent

A wax for use in the toner of an exemplary embodiment of the present invention as a releasing agent has a low melting point of from 50° C. to 120° C. When such a wax is included in the toner, the wax is dispersed in the binder resin and serves as a releasing agent at a location between a fixing roller and the toner particles. Thereby, hot offset resistance can be enhanced without applying an oil to the fixing roller used. Specific examples of the releasing agent include natural waxes such as vegetable waxes, e.g., camauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

These charge controlling agents and releasing agents can be dissolved and dispersed after being kneaded and receiving an application of heat together with a master batch pigment and a binder resin; and can be added when directly dissolved and dispersed in an organic solvent.

External Additives

The inorganic particulate material may have a primary particle diameter of from $5\times10^{-3}$ to 2 μm, and from $5\times10^{-3}$ to 0.5 μm. In addition, a specific surface area of the inorganic particulates measured by a BET method may be from 20 $m^2/g$ to 500 $m^2/g$. The content of the external additive may be from 0.01% to 5% by weight, and from 0.01% to 2.0% by weight, based on total weight of the toner.

Specific examples of the inorganic fine grains are silica, alumina, titanium oxide, barium titanate, magnesium titanate, calcium tiatanate, strontium titanate, zinc oxide, tin oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. Among them, as a fluidity imparting agent, hydrophobic silica fine grains and hydrophobic titanium oxide fine grains may be used in combination. Particularly, when such two kinds of fine grains, having a mean grain size of $5\times10^{-2}$ μm or below, are mixed together, there can be noticeably enhanced an electrostatic force and van del Waals force with the toner. Therefore, despite agitation effected in the developing device for implementing the desired charge level, the fluidity imparting agent does not part from the toner grains and insures desirable image quality free from spots or similar image defects. In addition, the amount of residual toner can be reduced.

Titanium oxide fine grains are desirable for environmental stability and image density stability, but tend to have lower charge start characteristics. Therefore, if the amount of titanium oxide fine particles is larger than the amount of silica fine grains, then the influence of the above side effect increases. However, so long as the amount of hydrophobic silica fine grains and hydrophobic titanium oxide fine grains is between 0.3 wt. % and 1.5 wt. %, the charge start characteristics are not noticeably impaired, i.e., desired charge start characteristics are achievable. Consequently, stable image quality is achievable despite repeated copying operations.

The toner of an exemplary embodiment of the present invention is produced by the following method, but the manufacturing method is not limited thereto.

Preparation of Toner

First, a colorant, unmodified polyester, polyester prepolymer having isocyanate groups and a parting agent are dispersed into an organic solvent to prepare a toner material liquid.

The organic solvent may be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. The amount of the organic solvent to be used may be 0 parts by weight to 300 parts by weight for 100 parts by weight of polyester prepolymer, 0 parts by weight to 100 parts by weight for 100 parts by weight of polyester prepolymer, and 25 parts by weight to 70 parts by weight for 100 parts by weight of polyester prepolymer.

The toner material liquid is emulsified in an aqueous medium in the presence of a surfactant and organic fine particles.

The aqueous medium for use in the exemplary embodiments of the present invention is water alone or a mixture of water with a solvent which can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium may typically be from 50 to 2,000 parts by weight, and may be from 100 to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, a-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium, 3-lomega-fluoroalkanoyl(C6-C8)-N-ethylamino}-1-propanesulfonate, fluoroalkyl(C11-C20)carboxylic acids and their metal salts, perfluoroalkylcarboxylic acids (7C-13C) and their metal salts, perfluoroalkyl(C4-C12) sulfonate and their metal salts, perfluorooctanesulfonic acid diethanol amides, N-propyl-N-(2-hydroxyethyl-)perfluorooctanesulfone amide, perfluoroalkyl(C6-C10)sulfoneamidepropyltrimethylammonium salts, salts of perfluoroalkyl (C6-C10)-N-ethylsulfonylglycin, monoperfluoroalkyl(C6-C16)e-thylphosphates, etc.

Specific examples of the marketed products of such surfactants having a fluoroalkyl group include SARFRON® S-111, S-112 and S-113, which are manufactured by ASAHI GLASS CO., LTD.; FLUORAD® FC-93, FC-95, FC-98 and FC-129, which are manufactured by SUMITOMO 3M LTD.; UNIDYNE® DS-101 and DS-102, which are manufactured by DAIKIN INDUSTRIES, LTD.; MEGAFACE® F-10, F-120, F-113, F-191, F-812 and F-833 which are manufactured by DAINPPON INK AND CHEMICALS, INC.; ECTOP EF-102, 103, 104, 105, 112, 123A, 123B, 306A, 501, 201 and 204, which are manufactured by TOHCHEM PRODUCTS CO., LTD.; FUTARGENT® F-100 and F150 manufactured by NEOS; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6-C10)sulfone-amidepropyltrimethylammonium salts, benzalkonium salts, benzetonium chloride, pyridinium salts, imidazolinium salts, etc. Specific examples of the marketed products thereof include SARFRON® S-121 (manufactured by ASAHI GLASS CO., LTD.); FLUORADT FC-135 (manufactured by SUMITOMO 3M LTD.); UNIDYNE DS-202 (manufactured by DAIKIN INDUSTRIES, LTD.); MEGAFACE®E F-150 and F-824 (manufactured by DAINIPPON INK AND CHEMICALS, INC.); ECTOP EF-132 (manufactured by TOHCHEM PRODUCTS CO., LTD.); FUTARGENT® F-300 (manufactured by NEOS); etc.

Resin fine particles are added to stabilize toner source particles formed in the aqueous solvent. The resin fine particles may be added such that the coverage ratio thereof on the surface of a toner source particle can be within 10% through 90%. For example, such resin fine particles may be methyl polymethacrylate particles of 1 μm and 3 μm, polystyrene particles of 0.5 μm and 2 μm, poly(styrene-acrylonitrile)particles of 1 μm, commercially, PB-200 (manufactured by KAO Co.), SGP, SGP-3G(manufactured by SOKEN), technopolymer SB (manufactured by SEKISUI PLASTICS CO., LTD.), micropearl (manufactured by SEKISUI CHEMICAL CO., LTD.) or the like.

Also, an inorganic dispersant such as calcium triphosphate, calcium carbonate, titanium oxide, colloidal silica, and hydroxyapatite may be used.

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, (β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and related art dispersion facilities, e.g., low speed shearing type, high speed shearing type, friction type, high pressure jet type and ultrasonic type dispersers can be used. Among them, the high speed shearing type dispersion methods may be used for preparing a dispersion including grains with a grain size of 2 μm to 20 μm. The number of rotations of the high speed shearing type dispersers is not particularly limited, but is usually 1,000 rpm (revolutions per minute) to 30,000 rpm, and may be 5,000 rpm to 20,000 rpm. While the dispersion time is not limited, it is usually 0.1 minute to 5 minutes for the batch system. The dispersion temperature may be 0° C. to 150° C., and 40° C. to 98° C. under a pressurized condition.

At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 minutes to 40 hours, and may be from 2 hours to 24 hours. The reaction temperature may typically be from 0° C. to 150° C., and from 40° C. to 98° C. In addition, a known catalyst such as dibutyltinlaurate and dioctyltinlaurate can be used. The amines (B) are used as the elongation agent and/or crosslinker.

After the above reaction, the organic solvent is removed from the emulsion (reaction product), and the resultant particles are washed and then dried. Thus, mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate may be removed from the toner mother particles by being dissolved by hydrochloric acid or similar acid, followed by washing with water. Further, such a dispersion stabilizer can be removed by a decomposition method using an enzyme.

Then a charge controlling agent is penetrated into the mother toner particles, and inorganic fine particles such as silica, titanium oxide etc. are added externally thereto to obtain the toner of an exemplary embodiment of the present invention.

In accordance with a related art method, for example, a method using a mixer, the charge controlling agent is provided, and the inorganic particles are added.

Thus, a toner having a small particle size and a sharp particle size distribution can be obtained. Moreover, by controlling the stirring conditions when removing the organic solvent, the particle shape of the particles can be controlled so as to be any shape between spherical and rugby ball shape. Furthermore, the conditions of the surface can also be controlled so as to be any condition from a smooth surface to a rough surface such as the surface of pickled plum.

With the above-described method, a more spherical toner than pulverized toner can be obtained, which may cause better granularity to obtain a high quality image without roughness. Further, the particle can be made smaller, which is further effective to produce high quality images. On the other hand, density nonuniformity may become obvious. Therefore, performing the above-described method in combination with the exemplary embodiment of the present invention can provide a developing device that can produce images having high quality and less density nonuniformity.

Now, the volume average particle diameter and the number average particle diameter of toner, which will be understood by those skilled in the art, are notated as Dv and Dn, respectively. When using toner having a small particle diameter and a concentrated particle diameter distribution, such as toner having a Dv value of between 3 μm and 8 μm and a ratio (Dv/Dn) between 1.00 and 1.40, the developing device 400 performs well.

To reproduce a small dot of 600 dpi or greater, the volume average particle diameter (Dv) of toner may fall in a range from 3 μm to 8 μm. In addition, the ratio (Dv/Dn) of the volume average particle diameter (Dv) to the number average particle diameter (Dn) may be in a range between 1.00 and 1.40.

When the ratio (Dv/Dn) is closer to a true spherical form, the toner particles have a sharp particle diameter distribution. The toner that includes particles having a small diameter and a sharp particle diameter distribution may have a uniform charging distribution, thereby images having good image quality can be formed without causing background fouling. Further, when an electrostatic transfer method is employed to the image forming apparatus, the transfer ability can be increased. Therefore, performing the above-described method in combination with the exemplary embodiments of the present invention can provide a developing device that can produce images having high quality and less density nonuniformity.

A shape factor "SF-1" of the toner used in the developing unit 4 may be in a range from approximately 100 to approximately 180, and the shape factor "SF-2" of the toner is in a range from approximately 100 to approximately 180.

Figure 6:
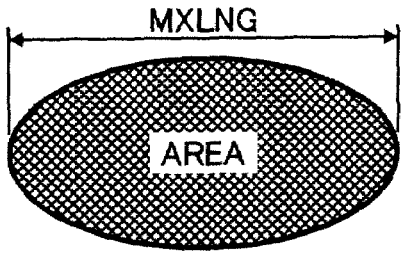
FIG. 6 is a drawing of a toner having an "SF1" shape factor.

Referring to FIG. 6, the shape factor "SF1" is a parameter representing the roundness of a particle. The shape factor "SF-1" of a particle is calculated by the following Equation 1:

$$SF1=\{(MXLNG)^2/AREA\}\times(100\pi/4) \qquad \text{Equation 1,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Figure 7:
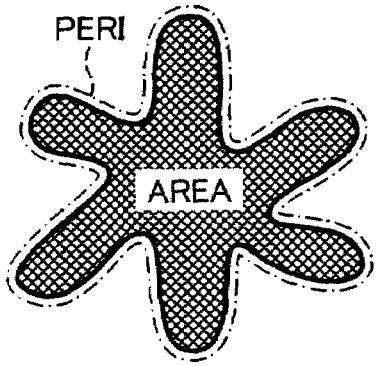
FIG. 7 is a drawing of a toner having an "SF2" shape factor.

Referring to FIG. 7, the shape factor "SF-2" is a value representing irregularity (i.e., a ratio of convex and concave portions) of the shape of the toner. The shape factor "SF-2" of a particle is calculated by the following Equation 2:

$$SF2=\{(PERI)^2/AREA\}\times(100\pi/4) \quad \text{Equation 2,}$$

where "PERI" represents the perimeter of a figure obtained by projecting a toner particle on a two dimensional plane.

When the value of the shape factor "SF-2" is 100, the surface of the toner is even (i.e., no convex and concave portions). As the value of the "SF-2" increases, the surface of the toner becomes uneven (i.e., the number of convex and concave portions increase).

In this exemplary embodiment, toner images are sampled by using a field emission type scanning electron microscope (FE-SEM) S-800 manufactured by HITACHI, LTD. The toner image information is analyzed by using an image analyzer (LUSEX3) manufactured by NIREKO, LTD.

As a toner particle has a higher roundness, the toner particle is more likely to make a point-contact with another toner particle on the photoconductive element 1. In this case, the adhesion force between these toner particles is weak, thereby making the toner particles highly flowable. Also, while weak adhesion force between the round toner particle and the photoconductive drum 11 enhances the transfer rate. The value exceeding 180 with respect to SF-1 and SF-2 tends to cause a lower transfer rate. Thus, SF-1 and SF-2 are preferred to be no more than 180.

As described above, a higher transfer rate can cause images to be reproduced in higher quality. That is, if a toner image has been developed unevenly, the transferred toner image may also be uneven in development. With the above-described condition, uneven development may become obvious. Therefore, performing the above-described method in combination with the exemplary embodiments of the present invention can provide a developing device that can produce images having high quality and less density nonuniformity.

Toner according to an exemplary embodiment of the present invention has a substantially spherical shape as provided by the following shape definition.

Figure 8A:
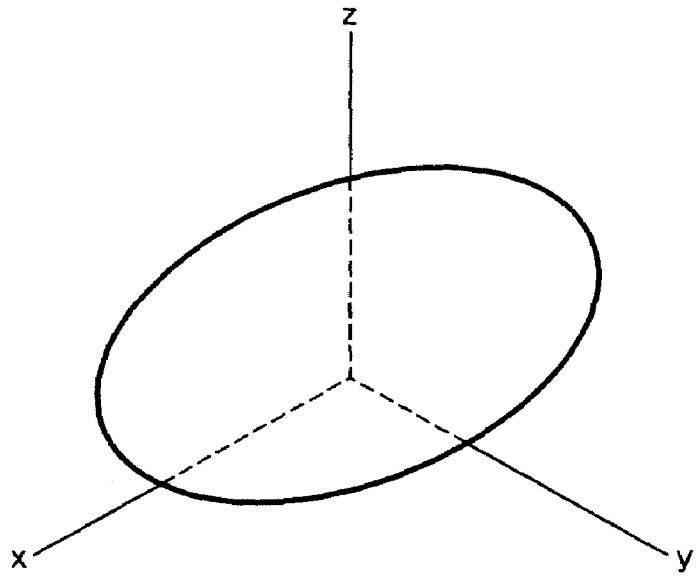
FIG. 8A is an outer shape of a toner used in the image forming apparatus of FIG. 1, and FIGS. 8B and 8C are schematic cross sectional views of the toner, showing major and minor axes and a thickness of FIG. 8A.
Figure 8B:
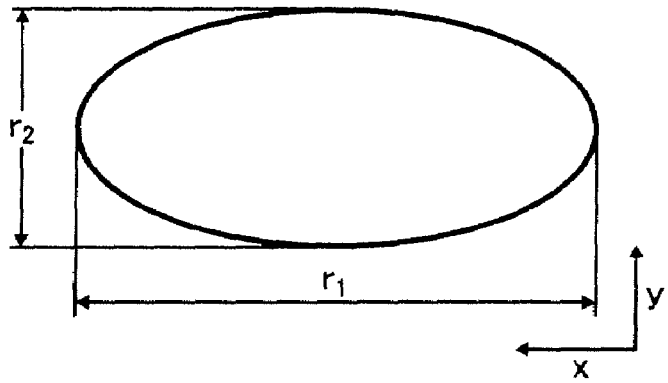
Figure 8C:
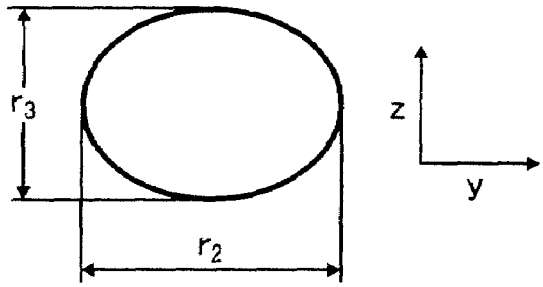

FIGS. 8A through 8C are schematic views showing an exemplary shape of a toner particle according to an exemplary embodiment of the present invention.

An axis x of FIG. 8A represents a major axis r1 of FIG. 8B, which is the longest axis of the toner. An axis y of FIG. 8A represents a minor axis r2 of FIG. 8C, which is the second longest axis of the toner. The axis z of FIG. 8A represents a thickness r3 of FIG. 8B, which is a thickness of the shortest axis of the toner. The toner has a relationship between the major and minor axes r1 and r2 and the thickness r3 as follows:

$$r1 \geqq r2 \geqq r3.$$

The toner of FIG. 8A may be in a spindle shape in which the ratio (r2/r1) of the major axis r1 to the minor axis r2 is approximately 0.5 to approximately 1.0, and the ratio (r3/r2) of the thickness r3 to the minor axis is approximately 0.7 to approximately 1.0.

It is noted that the lengths r1, r2 and r3 can be measured by distributing toner particles to uniformly adhere onto a flat plate, enlarging 100 particles of the distributed toner particles by 500 times by using a color laser microscope VK-8500 (manufactured by Keyence Corporation), measuring respective lengths r1, r2, and r3 (each in a unit of "μm") of the 100 toner particles, and obtaining according to arithmetic average values of the respective lengths. The present invention can provide a developing device that can reproduce images having high quality and less uneven development.

As previously described, the laser printer 100 serving as an image forming apparatus may integrally include the above-described various image forming components in the process cartridge 1 as shown in FIG. 2. The process cartridge 1 shown in FIG. 2 includes the charging device 20, the developing device 40 or 400, the photoconductive drum 11, and the cleaning device 70. However, the process cartridge 1 may include the developing device 40 or 400 and one of the photoconductive drum 11, the charging device 20, and the cleaning device 70. Further, the process cartridge 1 may be detachable with respect to the laser printer 100.

As described above, in the image forming apparatus 100 according to an exemplary embodiment of the present invention including the process cartridge 1 in which the developing device 400 and other image forming components are integrally mounted, the photoconductive drum 11 may be rotated at a predetermined peripheral velocity. While being rotated, the surface of the photoconductive drum 11 may uniformly be charged to a predetermined positive or negative potential by the charging device 20. Then, the optical writing unit 2 employing a slit exposure, a laser beam scanning exposure, or the like may expose the surface of the photoconductive drum 11 so that an electrostatic latent image can be formed on the peripheral surface of the photoconductive drum 11. The electrostatic latent image may then be developed to a visible toner image by the developing device 400. Each toner image of different colors of the corresponding photoconductive drum 11 may be transferred onto the transfer sheet S that is conveyed to the nip formed between the corresponding photoconductive drum 11 and the transfer belt 60 in synchronization with the rotation of the photoconductive drum 11. The toner images of different colors may be sequentially overlaid onto the surface of the transfer sheet S to form a color toner image thereon. The transfer sheet S having the color toner image thereon may be conveyed to the fixing device and fixed by the application of heat and pressure. The thus reproduced color toner image may be output as a copy. The cleaning device 70 may remove residual toner from the surface of the photoconductive drum 11 so as to prepare for the next image forming operation.

In the developing device 400 of the image forming apparatus 100 of an exemplary embodiment of the present invention, the developer distribution regulating member 50 is arranged at a position in which the developer distribution regulating member 50 is held in contact with the developer 49 brought up onto the developing roller 42. The developer distribution regulating member 50 can reduce or avoid non-uniformity of developer distribution due to screw pitch when bringing up the developer 49 onto the developing roller 42. That is, the developer distribution regulating member 50 can uniformly or evenly distribute the developer 49 on the surface of the developing roller 42 and can enhance agitation of the developer 49. With the above-described structure, a highly reliable image forming apparatus and a process cartridge included therein that may produce images without non-uniformity of developer distribution due to screw pitch can effectively be provided.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that the disclosure of this patent specification may be practiced otherwise than as specifically described herein.

Obviously, numerous modifications and variations of the present invention are possible in light of the above teachings. It is therefore to be understood that the invention may be practiced otherwise than as specifically described herein.

What is claimed:

1. An image forming apparatus, comprising:

an image bearing member configured to bear an image on a surface thereof; and a developing device configured to develop the image formed on the image bearing member by using a developer accommodated in a chamber thereof, the developing device comprising:

a developer bearing member configured to bear the developer on a surface thereof to transfer the developer to the image formed on the image bearing member;

a conveying member, disposed within the chamber, configured to agitate and convey the developer in the chamber to the developer bearing member, the chamber having a wall, the conveying member disposed between the wall and the developer bearing member;

a first regulating member held in contact with the developer brought up from the chamber onto the surface of the developing roller, the first regulating member configured to uniformly distribute the developer on the surface of the developer bearing member, the first regulating member contacting the wall of the chamber; and a second regulating member configured to regulate a thickness of a layer of the developer conveyed by the conveying member and uniformly distributed by the first regulating member onto the surface of the developer bearing member.

2. The image forming apparatus according to claim 1, further comprising:

a second conveying member disposed on the opposite side of the wall with respect to said conveying member and configured to agitate and convey the developer from a second chamber to said chamber.

3. The image forming apparatus according to claim 1, wherein:

the first regulating member is separately detachable with respect to the developing device.

4. The image forming apparatus according to claim 1, wherein:

the image forming apparatus includes carrier particles having a diameter in a range from approximately 20 μm to approximately 50 μm.

5. The image forming apparatus according to claim 1, wherein:

the image forming apparatus includes carrier particles having a magnetic core and a resin coat film coating the magnetic core; and the resin coat film includes a resin component obtained from a crosslinking reaction of a thermoplastic resin and a melanin resin and a charge controlling agent.

6. The image forming apparatus according to claim 1, wherein:

the image forming apparatus includes toner obtained from at least one of an elongation and a crosslinking reaction of toner composition comprising a polyester prepolymer having a function group including a nitrogen atom, a polyester, a colorant, and a releasing agent in an aqueous medium under resin fine particles.

7. The image forming apparatus according to claim 1, wherein:

the image forming apparatus includes toner having a volume-based average particle diameter from approximately 3 μm to approximately 8 μm and a distribution from approximately 1.00 to approximately 1.40, wherein the distribution is defined by a ratio of the volume-based average particle diameter to a number-based average diameter.

8. The image forming apparatus according to claim 1, wherein:

the image forming apparatus includes toner having a shape factor "SF-1" in a range from approximately 100 to approximately 180, and a shape factor "SF-2" in a range from approximately 100 to approximately 180.

9. The image forming apparatus according to claim 1, wherein:

the image forming apparatus includes toner having a spindle outer shape, and a ratio of a major axis r1 to a minor axis r2 from approximately 0.5 to approximately 1.0 and a ratio of a thickness r3 to the minor axis r2 from approximately 0.7 to approximately 1.0, where $r1 \geqq r2 \geqq r3$.

10. The image forming apparatus according to claim 1, further comprising:

a charging device configured to uniformly charge the surface of the image bearing member; and a cleaning device configured to remove residual toner remaining on the surface of the image bearing member, wherein the developing device and one of the image bearing member, the charging member, and the cleaning member are integrally mounted in a process cartridge.

11. A process cartridge, comprising:

an image bearing member; and a developing device configured to develop the image formed on the image bearing member by using a developer accommodated in a first chamber thereof, the developing device comprising:

a developer bearing member configured to bear the developer on a surface thereof to transfer the developer to the image formed on the image bearing member;

a first conveying member configured to agitate and convey the developer from the first chamber of the chamber to the developer bearing member, the first chamber having a wall, the conveying member disposed between the wall and the developer bearing member;

a second conveying member disposed on the opposite side of the wall with respect to the first conveying member and configured to agitate and convey the developer from a second chamber to the first chamber;

a first regulating member held in contact with the developer brought up from the first chamber onto the surface of the developing roller, the first regulating member configured to uniformly distribute the developer on the surface of the developer bearing member, the first regulating member contacting the wall of the first chamber; and a second regulating member configured to regulate a thickness of a layer of the developer conveyed by the conveying member and uniformly distributed by the first regulating member onto the surface of the developer bearing member.

12. The process cartridge according to claim 11, wherein:

the first regulating member is separately detachable with respect to the developing device.

13. The process cartridge according to claim 11, wherein:

the process cartridge includes carrier particles having a diameter in a range from approximately 20 μm to approximately 50 μm.

14. The process cartridge according to claim 11, wherein:

the process cartridge includes carrier particles having a magnetic core and a resin coat film coating the magnetic core; and the resin coat film includes a resin component obtained from a crosslinking reaction of a thermoplastic resin and a melanin resin and a charge controlling agent.

15. A developing device, comprising:

a developer bearing member configured to bear a developer accommodated in a first chamber of the developing device to transfer the developer to an image formed on an image bearing member;

a first conveying member configured to agitate and convey the developer from the first chamber to the developer bearing member, the first chamber having a wall, the conveying member disposed between the wall and the developer bearing member;

a second conveying member disposed on the opposite side of the wall with respect to the first conveying member and configured to agitate and convey the developer from a second chamber to the first chamber; and a first regulating member held in contact with the developer brought up from the first chamber onto the surface of the developing roller, the first regulating member configured to uniformly distribute the developer on the surface of the developer bearing member, the first regulating member contacting the wall of the first chamber; and a second regulating member configured to regulate a thickness of a layer of the developer conveyed by the conveying member and uniformly distributed by the first regulating member onto the surface of the developer bearing member.

16. The developing member according to claim 15, wherein:

the first regulating member is separately detachable with respect to the developing device.

17. The developing device according to claim 15, wherein:

the developing device includes carrier particles having a diameter in a range from approximately 20 μm to approximately 50 μm.

18. The developing device according to claim 15, wherein:

the developing device includes carrier particles having a magnetic core and a resin coat film coating the magnetic core; and the resin coat film includes a resin component obtained from a crosslinking reaction of a thermoplastic resin and a melanin resin and a charge controlling agent.

* * * * *